US009308719B2

(12) United States Patent
Kameyama et al.

(10) Patent No.: US 9,308,719 B2
(45) Date of Patent: Apr. 12, 2016

(54) PRINTHEAD BOARD, PRINTHEAD, AND PRINTING APPARATUS

(71) Applicant: CANON KABUSHIKI KAISHA, Tokyo (JP)

(72) Inventors: Hiroaki Kameyama, Kawasaki (JP); Masanobu Ohmura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 14/193,257

(22) Filed: Feb. 28, 2014

(65) Prior Publication Data

US 2014/0247299 A1 Sep. 4, 2014

(30) Foreign Application Priority Data

Mar. 1, 2013 (JP) ..... 2013-041266

(51) Int. Cl.
*B41J 29/38* (2006.01)
*B41J 2/045* (2006.01)

(52) U.S. Cl.
CPC ..... *B41J 2/0451* (2013.01); *B41J 2/0458* (2013.01); *B41J 2/04501* (2013.01); *B41J 2/04541* (2013.01); *B41J 2/04565* (2013.01); *B41J 2/04581* (2013.01); *B41J 2/04591* (2013.01)

(58) Field of Classification Search
USPC ..... 347/14, 10, 19
See application file for complete search history.

(56) References Cited

U.S. PATENT DOCUMENTS

| | | | | |
|---|---|---|---|---|
| 7,467,864 | B2 | 12/2008 | Matsui et al. | |
| 7,581,797 | B2 | 9/2009 | Kasai | |
| 7,591,538 | B2 * | 9/2009 | Toge et al. | 347/50 |
| 7,661,799 | B2 * | 2/2010 | Kubo | B41J 2/04541 347/50 |

(Continued)

FOREIGN PATENT DOCUMENTS

| | | | |
|---|---|---|---|
| CN | 1626353 | A | 6/2005 |
| CN | 101200142 | A | 6/2008 |
| EP | 2072260 | A2 | 6/2009 |

(Continued)

OTHER PUBLICATIONS

Office Action in Chinese Patent Application No. 201410069616.4, dated May 5, 2015.

*Primary Examiner* — Erica Lin
*Assistant Examiner* — Lily Kemathe
(74) *Attorney, Agent, or Firm* — Fitzpatrick, Cella, Harper & Scinto

(57) ABSTRACT

A board for a printhead mountable on a printing apparatus includes three terminals used for connection to the printing apparatus, a printing element, a driving circuit connected to the first terminal, an inspection circuit connected between the first terminal and the second terminal, and a resistance element connected between the second terminal and the third terminal. When an inspection signal is supplied from the printing apparatus to the first terminal, the inspection circuit outputs an output signal according to the inspection signal. When a control signal for performing printing is supplied from the printing apparatus to the first terminal, the driving circuit drives the printing element according to the control signal, and the inspection circuit sets the inspection circuit and the second terminal in an open state with each other.

13 Claims, 5 Drawing Sheets

(56) References Cited

U.S. PATENT DOCUMENTS

| | | | | |
|---|---|---|---|---|
| 7,802,858 | B2 | 9/2010 | Kasai | |
| 7,841,678 | B2 | 11/2010 | Imanaka et al. | |
| 8,057,000 | B2 | 11/2011 | Imanaka et al. | |
| 2005/0285904 | A1* | 12/2005 | Toge et al. | 347/58 |
| 2007/0296763 | A1* | 12/2007 | Kubo | B41J 2/04541 347/50 |
| 2010/0315454 | A1 | 12/2010 | Kanno | |
| 2011/0032295 | A1* | 2/2011 | Imanaka et al. | 347/10 |

FOREIGN PATENT DOCUMENTS

| | | | |
|---|---|---|---|
| JP | 2004-090246 | A | 3/2004 |
| JP | 2007-008064 | A | 1/2007 |
| JP | 2011-037196 | A | 2/2011 |

* cited by examiner

PRINTHEAD BOARD, PRINTHEAD, AND PRINTING APPARATUS

BACKGROUND OF THE INVENTION

1. Field of the Invention

The present invention relates to a printhead board, a printhead, and a printing apparatus.

2. Description of the Related Art

For some printing apparatuses such as an inkjet printer, a printhead for discharging ink is detachable from a printing apparatus. A printing apparatus and a printhead have connection terminals, respectively, through which the printing apparatus and the printhead are connected to each other. Japanese Patent Laid-Open No. 2007-008064 proposes a technique in which a printhead outputs a signal to a printing apparatus in accordance with a signal supplied from the printing apparatus in order for the printing apparatus to determine whether the printing apparatus and the printhead are connected to each other. The printhead has a connection terminal dedicated for outputting a signal indicating whether the printhead is connected to the printing apparatus.

Furthermore, Japanese Patent Laid-Open No. 2004-090246 proposes a technique in which a resistance element (rank heater) with the same arrangement as that of a heat generation element for discharging ink is formed on a printhead board and a printing apparatus measures the resistance value of the resistance element to set optimum driving conditions for the heat generation element. Both ends of the resistance element of the printhead are connected to dedicated connection terminals, respectively, and the printing apparatus measures the resistance value between the two connection terminals.

SUMMARY OF THE INVENTION

According to a first aspect, a board for a printhead mountable on a printing apparatus, includes a first terminal, a second terminal, and a third terminal which are used for connection to the printing apparatus; a printing element configured to discharge a liquid; a driving circuit connected to the first terminal; an inspection circuit connected between the first terminal and the second terminal; and a resistance element connected between the second terminal and the third terminal, wherein when an inspection signal for inspecting a connection state between the printing apparatus and the printhead is supplied from the printing apparatus to the first terminal, the inspection circuit outputs an output signal according to the inspection signal from the second terminal, and when a control signal for performing printing is supplied from the printing apparatus to the first terminal, the driving circuit drives the printing element according to the control signal, and the inspection circuit sets the inspection circuit and the second terminal in an open state with each other.

According to a second aspect, a printing apparatus on which a printhead is mountable, includes a first terminal, a second terminal, and a third terminal which are used for connection to the printhead; a determination unit for determining a connection state between the printing apparatus and the printhead based on a voltage of the second terminal when an inspection signal is output from the first terminal; a print control unit for outputting, from the first terminal, a control signal for driving the printhead to discharge a liquid; and a measurement unit for measuring a resistance value between the second terminal and the third terminal.

Further features of the present invention will become apparent from the following description of exemplary embodiments (with reference to the attached drawings).

DESCRIPTION OF THE EMBODIMENTS

Figure 1:
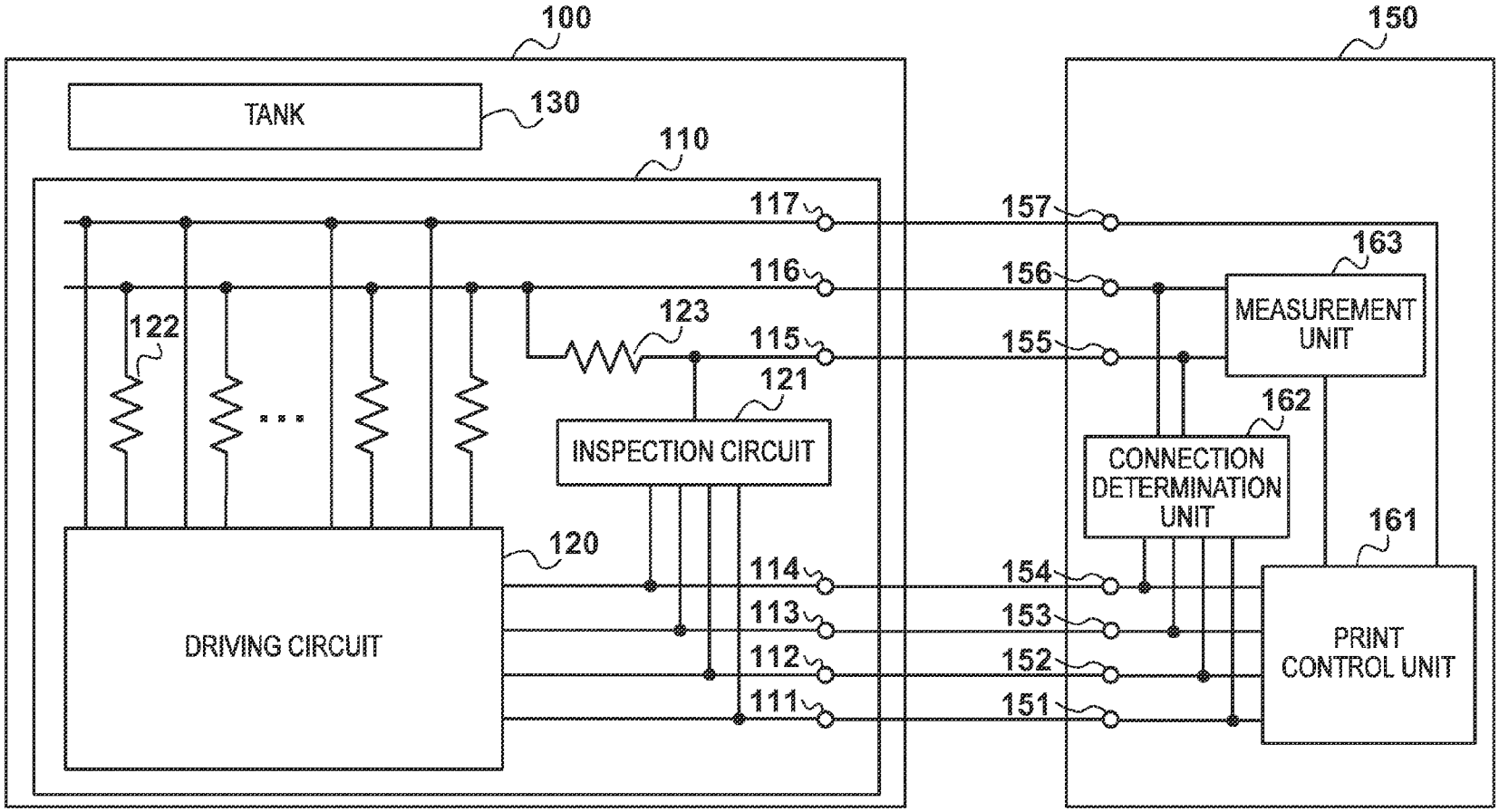
FIG. 1 is a circuit diagram for explaining an example of the arrangement of a printing apparatus and a printhead according to some embodiments of the present invention.

If the connection terminal for outputting a signal indicating a connection state described in Japanese Patent Laid-Open No. 2007-008064 and the connection terminals respectively connected to both ends of the resistance element described in Japanese Patent Laid-Open No. 2004-090246 are mounted on one printhead, the number of connection terminals accordingly increases. Since an increase in number of connection terminals increases the size of the printhead, it is not preferable. To solve this problem, one aspect of the present invention provides a technique of decreasing the number of connection terminals which connect a printing apparatus and a printhead.

Embodiments of the present invention will be described below with reference to the accompanying drawings. Through the various embodiments, the same reference numerals denote the same elements and a repetitive description will be omitted. The respective embodiments can be changed or combined, as needed. Some embodiments of the present invention relate to a printing apparatus such as an inkjet printer which performs printing by discharging a liquid such as ink from a printhead toward a printing medium such as a paper sheet. The printhead has a board on which a printing element for applying energy to ink to discharge the ink from a nozzle is formed. The printing element may be a piezoelectric element which deforms upon supply of an electric current, and pushes out the ink, or a heating element (heater) which heats up upon supply of an electric current and generates bubbles to push out the ink. Furthermore, the printhead may be a cartridge type printhead in which a tank for storing ink is integrated with the printhead itself or a printhead with a holding structure for detachably holding a tank. In the following embodiments, a case in which the printhead is of a cartridge type and a heating element is used as a printing element will be described. The printhead is manufactured as an exchangeable part, and can be mounted on the printing apparatus.

An example of the arrangement of a printhead 100 and a printing apparatus 150 according to some embodiments of the present invention will be described with reference to FIG. 1.

The printing apparatus 150 can include terminals 151 to 157, a print control unit 161, a connection determination unit 162, and a measurement unit 163. The printhead 100 can include a board 110 and a tank 130. On the board 110, terminals 111 to 117, a driving circuit 120, an inspection circuit 121, a plurality of heating elements 122, and a resistance element 123 can be formed. The heating elements 122 can be, for example, heat generation elements.

The printhead 100 and printing apparatus 150 are electrically connected to each other via the terminals 111 to 117 and 151 to 157. More specifically, the terminals 111 to 117 are connected with the terminals 151 to 157 in a one-to-one correspondence, as shown in FIG. 1. These terminals may be formed by conductive pads or metal pins. The printhead 100 and printing apparatus 150 may be electrically connected to each other when the terminals directly contact with each other or are electrically connected via cables.

The print control unit 161 of the printing apparatus 150 outputs control signals for controlling the operation of the driving circuit 120 from the terminals 151 to 154, and applies a voltage to the terminal 157, thereby controlling the printhead 100 to perform printing. The driving circuit 120 of the printhead 100 drives the heating elements 122 according to the control signals supplied from the printing apparatus 150 to the terminals 111 to 114 (first terminals). More specifically, the driving circuit 120 heats one of the plurality of heating elements 122 which corresponds to a nozzle that should discharge ink by applying an electric current according to the voltage of the terminal 117 to the heating element. The tank 130 supplies the ink to the nozzle, and the heating element 122 is heated to discharge the ink from the nozzle toward a printing medium.

The connection determination unit 162 of the printing apparatus 150 outputs inspection signals for determining the connection state between the printhead 100 and the printing apparatus 150 from the terminals 151 to 154. The inspection circuit 121 of the printhead 100 outputs, from the terminal 115 (second terminal), an output signal according to the inspection signals supplied from the printing apparatus 150 to the terminals 111 to 114. Based on the output signal supplied to the terminal 155, the connection determination unit 162 determines the connection state between the printhead 100 and the printing apparatus 150.

The measurement unit 163 of the printing apparatus 150 measures a resistance value between the terminals 155 and 156, and supplies the measured value to the print control unit 161. Based on the resistance value, the print control unit 161 adjusts at least control signals to be supplied to the printhead 100 or a voltage to be applied to the terminal 157.

Figure 2:
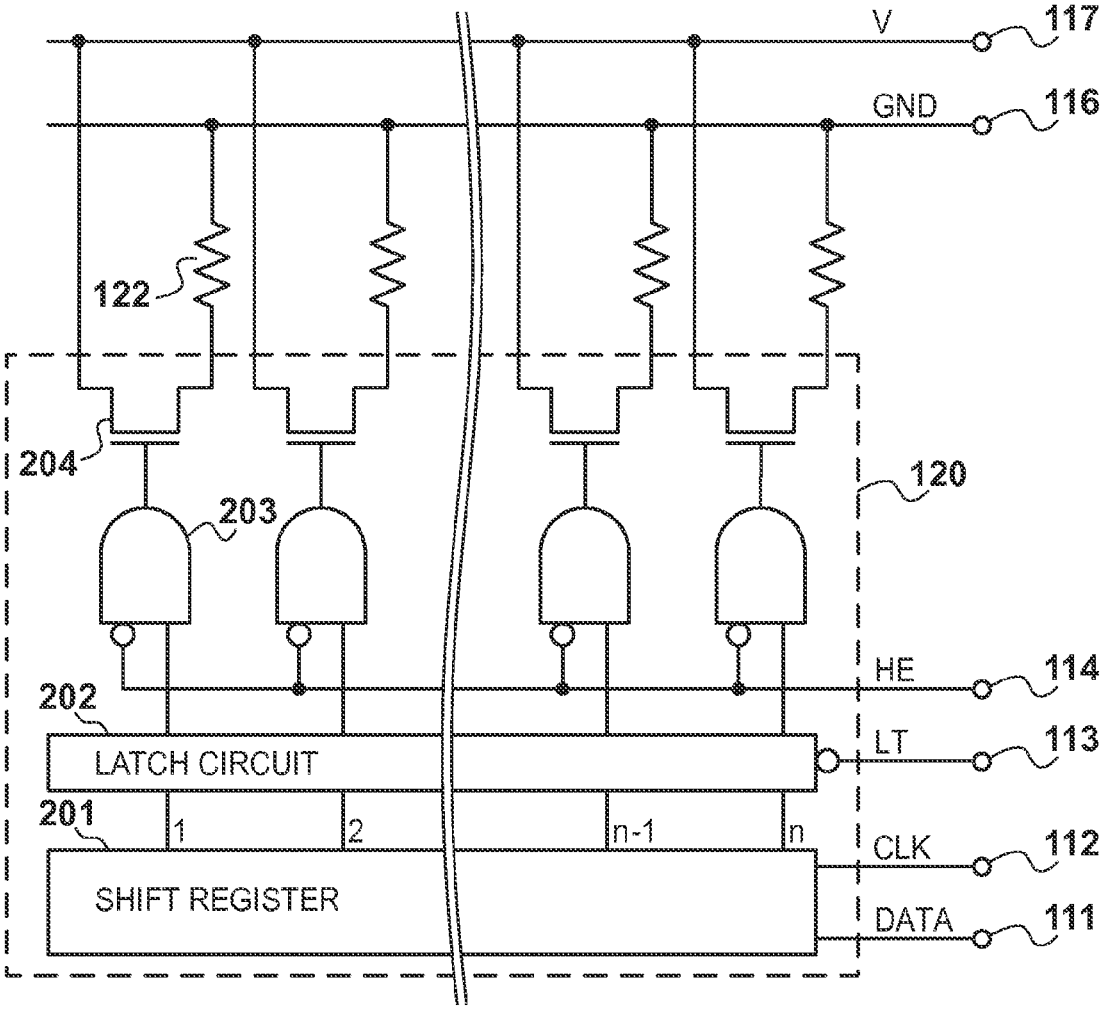
FIG. 2 is a circuit diagram for explaining an example of the arrangement of a driving circuit according to some embodiments of the present invention.

An example of the arrangement of the driving circuit 120 will be described next with reference to FIG. 2. The driving circuit 120 may have any arrangement as long as it can drive the heating elements 122 according to the control signals from the printing apparatus 150, and an existing arrangement may be used. The driving circuit 120 shown in FIG. 2 includes a shift register 201 and a latch circuit 202, and includes an AND circuit 203 and a transistor 204 for each of the plurality of heating elements 122. The shift register 201 can store n-bit data (n is an integer of 2 or larger). The data input terminal of the shift register 201 is connected to the terminal 111, and the clock input terminal of the shift register 201 is connected to the terminal 112. The n output terminals of the shift register 201 are connected to the n input terminals of the latch circuit in a one-to-one correspondence. The latch circuit 202 can store n-bit data. The set terminal of the latch circuit 202 is connected to the terminal 113 via an inverter. The n output terminals of the latch circuit 202 are connected to the first input terminals of the AND circuits 203, respectively. The second input terminals of the AND circuits 203 are connected to the terminal 114 via inverters, respectively. The output terminals of the AND circuits 203 are connected to the control terminals (gates) of the corresponding transistors 204, respectively. The transistors 204 are, for example, NMOS transistors each having a first main electrode (for example, a drain) connected to the terminal 117 and a second main electrode (for example, a source) connected to one end of the corresponding heating element 122. The other end of each heating element 122 is connected to the terminal 116 (third terminal).

Figure 3:
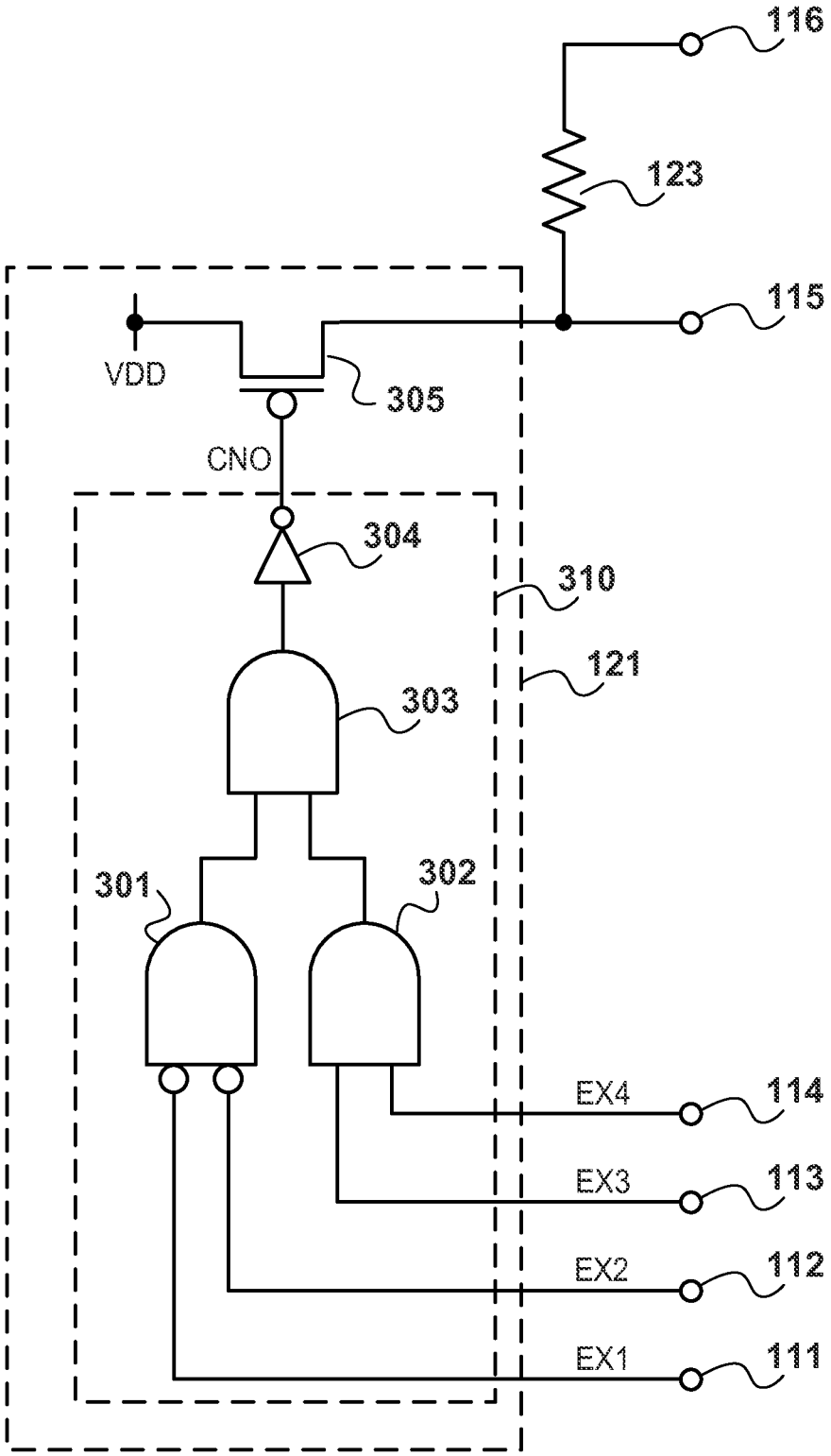
FIG. 3 is a circuit diagram for explaining an example of the arrangement of an inspection circuit according to some embodiments of the present invention.

An example of the arrangement of the inspection circuit 121 will be described next with reference to FIG. 3. The inspection circuit 121 shown in FIG. 3 includes three AND circuits 301 to 303, an inverter 304, and a transistor 305. The first input terminal of the AND circuit 301 is connected to the terminal 111 via an inverter, and the second input terminal of the AND circuit 301 is connected to the terminal 112 via an inverter. The first input terminal of the AND circuit 302 is connected to the terminal 113, and the second input terminal of the AND circuit 302 is connected to the terminal 114. The first input terminal of the AND circuit 303 is connected to the output terminal of the AND circuit 301, and the second input terminal of the AND circuit 303 is connected to the output terminal of the AND circuit 302. The output terminal of the AND circuit 303 is connected to the input terminal of the inverter 304, and the output terminal of the inverter 304 is connected to the control terminal (gate) of the transistor 305. The transistor 305 is, for example, a PMOS transistor which has a first main electrode (for example, a drain) connected to the terminal 115 and a second main electrode (for example, a source) connected to a voltage source VDD. One end of the resistance element 123 is connected to the terminal 115 and the other end of the resistance element 123 is connected to the terminal 116. The AND circuits and inverters, which are connected between the terminals 111 to 114 and the transistor 305, form a logical circuit 310. A logical value output from the logical circuit 310 (that is, output from the inverter 304) will be represented by CNO hereinafter. The transistor 305 may be an NMOS transistor. In this case, the inverter 304 becomes unnecessary.

Figure 4A:
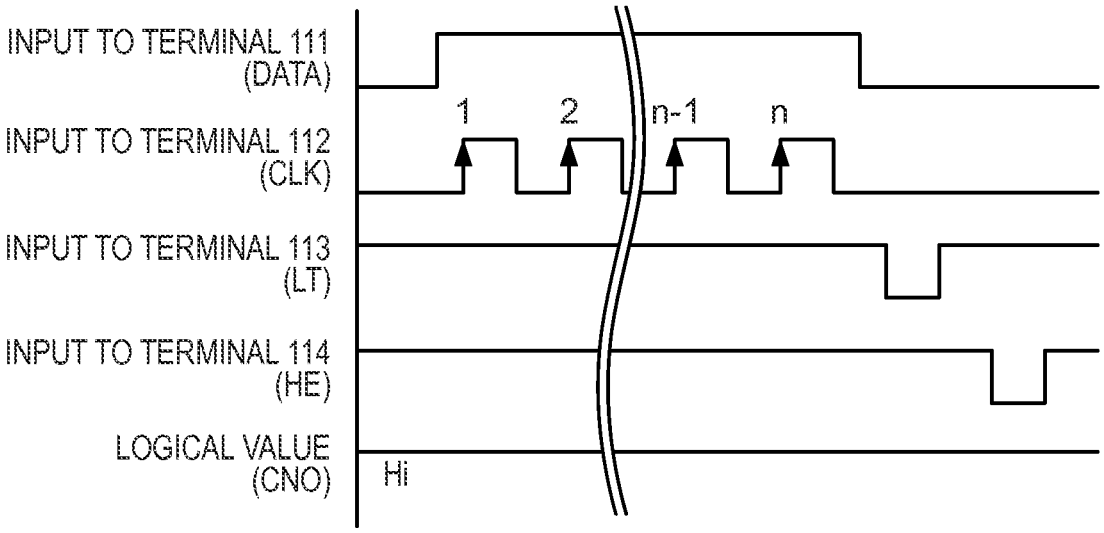
FIGS. 4A and 4B are timing charts for explaining an example of the operation of the printing apparatus and printhead according to some embodiments of the present invention.

An example of the operation of the printhead 100 and printing apparatus 150 will be described next with reference to timing charts shown in FIGS. 4A and 4B. The operation of the printing apparatus 150 and driving circuit 120 when the printing apparatus 150 performs printing using the printhead 100 will be explained first with reference to FIG. 4A together with FIG. 2. In printing, the print control unit 161 of the printing apparatus 150 outputs, as control signals, an image signal DATA from the terminal 151, a clock signal CLK from the terminal 152, a latch signal LT from the terminal 153, and a driving signal HE from the terminal 154. That is, the print control unit 161 parallelly supplies the four signals to the printhead 100 as control signals. When the printhead 100 is connected to the printing apparatus 150, the image signal DATA is input to the terminal 111, the clock signal CLK is input to the terminal 112, the latch signal LT is input to the terminal 113, and the driving signal HE is input to the terminal 114.

The image signal DATA is a signal obtained by serializing image data to be printed. When the image signal DATA is at high level, it indicates that the ink should be discharged. When the image signal DATA is at low level, it indicates that the ink should not be discharged. The image signal DATA is input to the data input terminal of the shift register 201. The clock signal CLK is a signal indicating the timing when the shift register 201 shifts the stored data, and input to the clock input terminal of the shift register 201. When the clock signal CLK rises, the shift register 201 shifts the stored data. As shown in FIG. 4A, when the clock signal CLK rises n times, the shift register 201 stores n-bit image data.

The latch signal LT is a signal for driving the latch circuit 202, and is input to the set terminal of the latch circuit 202 via the inverter. When the latch signal LT is at low level, the latch circuit 202 stores a signal supplied to its input terminal. When the latch signal LT is at high level, the latch circuit 202 outputs the signal stored in itself from the output terminal. As shown in FIG. 4A, after the shift register 201 stores the n-bit image data, the latch signal LT switches from high level to low level, thereby storing the image data of n bits in the latch circuit 202.

The driving signal HE is a signal indicating the timing when the heating element 122 discharges the ink, and is input to one input terminal of the AND circuit 203 via the inverter. As shown in FIG. 4A, after the latch circuit 202 stores the n-bit image data, the driving signal HE switches from high level to low level, and the signal supplied to one input terminal of the AND circuit 203 switches to high level. In this case, if a signal supplied from the latch circuit 202 to the other input terminal of the AND circuit 203 is at high level, an output signal from the AND circuit 203 is also set to high level, the transistor is rendered conductive, and an electric current flows through the heating element 122, thereby discharging the ink. If the signal supplied from the latch circuit 202 to the other input terminal of the AND circuit 203 is at low level, the output signal from the AND circuit 203 remains at low level, the transistor remains non-conductive, and no electric current flows through the heating element 122, thereby preventing the ink from being discharged.

An example of the operation of the printing apparatus 150 and inspection circuit 121 when the printing apparatus 150 inspects the connection state with the printhead 100 will be described next with reference to FIG. 4B together with FIG. 3. The connection determination unit 162 of the printing apparatus 150 outputs, as inspection signals, a first inspection signal EX1 from the terminal 151, a second inspection signal EX2 from the terminal 152, a third inspection signal EX3 from the terminal 153, and a fourth inspection signal EX4 from the terminal 154. That is, the connection determination unit 162 parallelly supplies the four signals to the printhead 100 as inspection signals. When the printhead 100 is connected to the printing apparatus 150, the first inspection signal EX1 is input to the terminal 111, the second inspection signal EX2 is input to the terminal 112, the third inspection signal EX3 is input to the terminal 113, and the fourth inspection signal EX4 is input to the terminal 114. As a result, the first inspection signal EX1 and the second inspection signal EX2 are supplied to the input terminals of the AND circuit 301 via the inverters, and the third inspection signal EX3 and the fourth inspection signal EX4 are supplied to the input terminals of the AND circuit 302. When the first inspection signal EX1 and the second inspection signal EX2 are at low level and the third inspection signal EX3 and the fourth inspection signal EX4 are at high level, the logical value CNO output from the logical circuit 310 is set to high level (true); otherwise, the logical value CNO is set to low level (false).

When the logical value CNO is at high level, the transistor 305 is rendered conductive, and the voltage of the terminal 115 becomes equal to the voltage of the voltage source VDD. When the logical value CNO is at low level, the transistor 305 remains non-conductive, and the inspection circuit 121 and the terminal 115 are set in an open state. Note that the open state indicates a state in which no electric current flows from the inspection circuit 121 to the terminal 115.

Figure 4B:
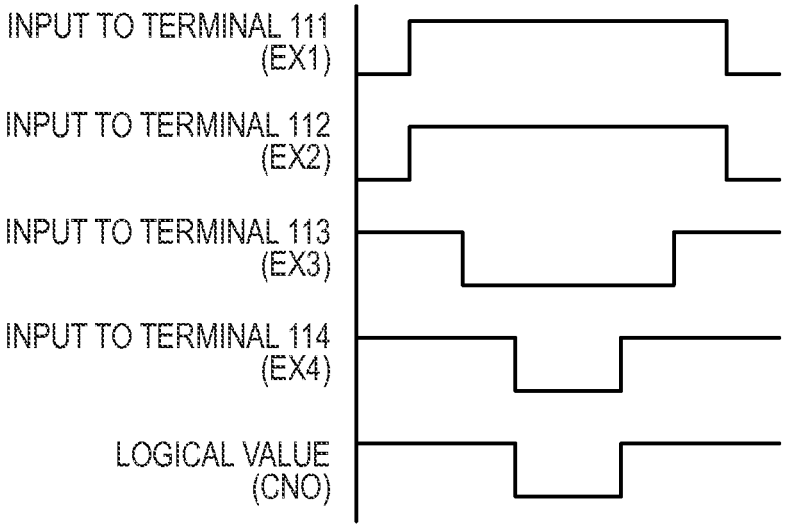

To determine the connection state with the printhead 100, the connection determination unit 162 of the printing apparatus 150 outputs inspection signals of waveforms shown in FIG. 4B from the terminals 151 to 154, and applies a ground voltage to the terminal 156. While the printing apparatus 150 and the printhead 100 are connected to each other, if the logical value CNO is at low level, the voltage of the terminal 155 becomes equal to the ground voltage, and if the logical value CNO is at high level, the voltage of the terminal 155 becomes equal to the voltage of the voltage source VDD. If, therefore, the voltage of the terminal 155 switches when outputting the inspection signals, the connection determination unit 162 can determine that the printing apparatus 150 and the printhead 100 are connected to each other. On the other hand, even if the connection determination unit 162 outputs the inspection signals of the waveforms shown in FIG. 4B, when the printing apparatus 150 and the printhead 100 are not connected to each other, the voltage of the terminal 155 does not change. Therefore, if the voltage of the terminal 155 does not switch when outputting the inspection signals, the connection determination unit 162 can determine that the printing apparatus 150 and the printhead 100 are not connected to each other.

The operation of the printing apparatus 150 and inspection circuit 121 when the printing apparatus 150 performs printing using the printhead 100 will be described with reference to FIG. 4A. When the print control unit 161 of the printing apparatus 150 supplies the control signals shown in FIG. 4A to the printhead 100, the logical value CNO output from the logical circuit 310 remains at low state even after a period of time elapses. In this way, when the printing apparatus 150 supplies, to the printhead 100, the control signals which set the logical value CNO output from the logical circuit 310 to a constant value, it is possible to suppress generation of noise, in the inspection circuit 121, which influences the operation of the printhead 100 in printing.

Furthermore, if the logical value CNO is at low level, the inspection circuit 121 and the terminal 115 are set in an open state. Therefore, the resistance value between the terminals 115 and 116 becomes equal to the resistance value of the resistance element 123. In this case, the measurement unit 163 of the printing apparatus 150 can measure the resistance value of the resistance element 123 by applying the ground voltage to the terminal 156, and measuring an electric current flowing through the terminal 155 when applying a voltage of another value to the terminal 155. Based on the resistance value of the resistance element 123, the print control unit 161 adjusts the driving conditions of the printhead 100. For example, by adjusting at least one of the value of a voltage V to be applied to the terminal 157 and the pulse width of the driving signal HE, heat energy generated by the heating element 122 is made close to a target value.

Figure 5A:
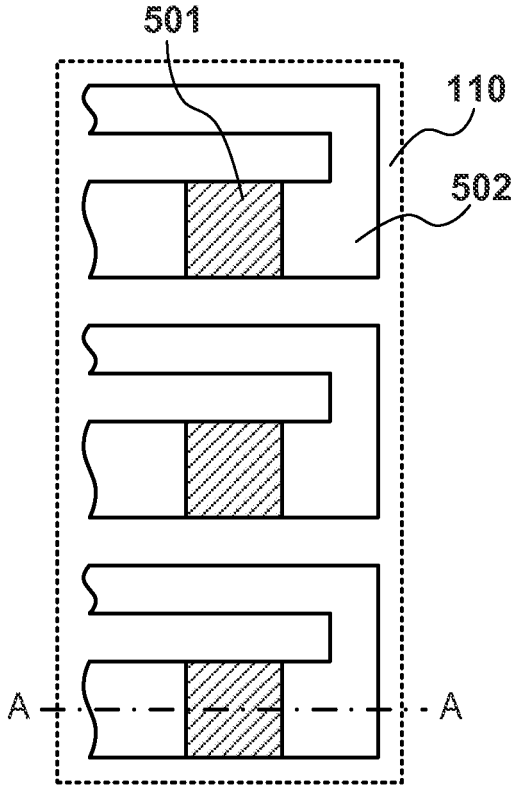
FIGS. 5A and 5B are views for explaining an example of the structure of the heating elements of the printhead according to the embodiments of the present invention.
Figure 5B:
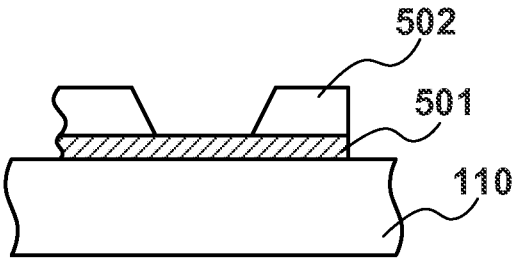

In order for the print control unit 161 of the printing apparatus 150 to adjust the heating element 122 with high accuracy, the heating element 122 and the resistance element 123 may be formed on the board 110 so as to have the same structure. An example of such formation will be described with reference to FIGS. 5A to 6B. The above-described printhead board 110 can be formed by, for example, performing a standard process for manufacturing a large scale integrated circuit (LSI) for a semiconductor board. FIG. 5A is a plan view showing a portion of the board 110, in which three heating elements 122 are formed. FIG. 5B is a sectional view taken along a line A-A shown in FIG. 5A. Each heating element 122 can be formed by forming a heater material 501 such as nichrome on the board 110, and forming an electrically conductive pattern 502 of copper or the like on the heater material 501. A portion of the heater material 501, which is exposed from the electrically conductive pattern 502, functions as the heating element 122.

Figure 6A:
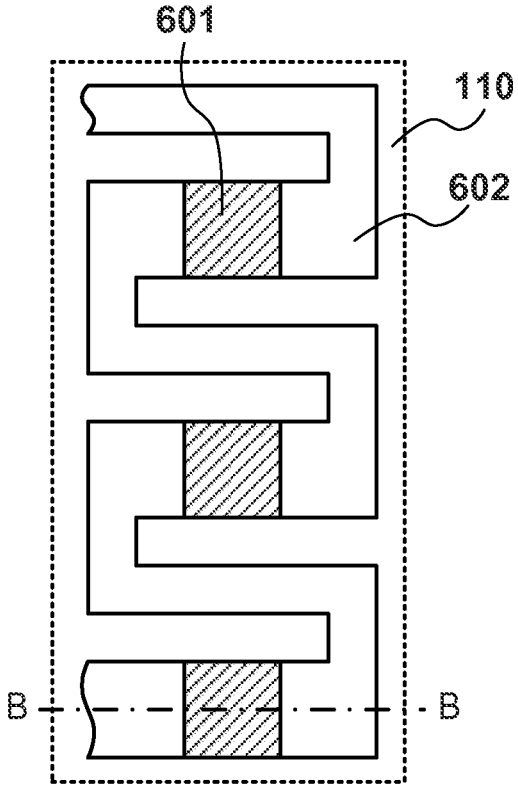
FIGS. 6A and 6B are views for explaining an example of the structure of the resistance element of the printhead according to the embodiments of the present invention.
Figure 6B:
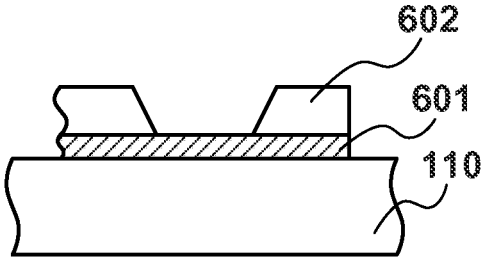

FIG. 6A is a plan view showing a portion of the board 110, in which the resistance element 123 is formed. FIG. 6B is a sectional view taken along a line B-B shown in FIG. 6A. The resistance element 123 can be formed by forming a heater material 601 such as nichrome on the board 110, and forming an electrically conductive pattern 602 of copper or the like on the heater material 601. A portion of the heater material 601, which is exposed from the electrically conductive pattern 602, functions as the resistance element 123. The heater materials 501 and 601 may be formed in one process, and the electrically conductive patterns 502 and 602 may be formed in one process. In this way, when the heating element 122 and the resistance element 123 have the same structure, the print control unit 161 of the printing apparatus 150 can estimate the resistance value of the heating element 122 based on the resistance value of the resistance element 123. In the example shown in FIGS. 5A to 6B, the electrically conductive patterns are formed on the heater materials. However, the heater materials may be formed on the electrically conductive patterns.

In the above-described embodiments, the terminal 115 of the printhead 100 is used not only to output a signal from the inspection circuit 121 but also to measure the resistance value of the resistance element 123. This decreases the number of terminals used in the printhead 100 to connect to the printing apparatus 150. Especially when the heating elements 122 are arranged along one side of the board 110 and the connection terminals 111 to 117 are arranged along a side perpendicular to the side of the board 110, the size of the printhead 100 depends on the number of connection terminals. Therefore, decreasing the number of terminals reduces the size of the printhead 100.

The present invention is not limited to the above-described embodiments. For example, the inspection circuit 121 may have any arrangement in which the inspection circuit 121 and the terminal 115 are set in an open state when the printing apparatus 150 supplies control signals, and the voltage of the terminal 115 changes when the printing apparatus 150 supplies inspection signals. For example, the inspection circuit 121 may include a switch for realizing the open state and a logical circuit for controlling the opening/closing (on/off) of the switch. The switch has a first terminal connected to the terminal 115, a second terminal connected to the voltage source, and a control terminal supplied with the output of the logical circuit. The switch may be a MOS transistor as described above, or a bipolar transistor. The logical circuit may have any arrangement which outputs a constant logical value when the printing apparatus 150 supplies control signals, and changes the logical value to be output when the printing apparatus 150 supplies inspection signals.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-041266, filed Mar. 1, 2013, which is hereby incorporated by reference herein in its entirety.

What is claimed is:

1. A board for a printhead mountable on a printing apparatus, comprising:

a first terminal, a second terminal, and a third terminal, which are used for connection to the printing apparatus;

a printing element configured to discharge a liquid;

a driving circuit connected to said first terminal;

an inspection circuit having an input node connected to said first terminal and an output node connected to said second terminal; and a resistance element having a first node connected to said third terminal and a second node connected to an electrical path between the output node of said inspection circuit and said second terminal, wherein when an inspection signal for inspecting a connection sate between the printing apparatus and the printhead is supplied from the printing apparatus to said first terminal, said inspection circuit outputs signal according to the inspection signal from said second terminal, and, when a control signal for performing printing is supplied from the printing apparatus to said first terminal, said driving circuit drives said printing element according to the control signal, and said inspection circuit sets said inspection circuit and said second terminal in an open state with each other.

2. The board according to claim 1, wherein when the control signal is supplied from the printing apparatus to said first terminal, an electric current determined based on a voltage applied by the printing apparatus between said second terminal and said third terminal and a resistance value of said resistance element is supplied to the printing apparatus.

3. The board according to claim 1, wherein said printing element is a heating element, and said resistance element has the same physical structure as that of said printing element.

4. The board according to claim 1, wherein said inspection circuit includes a logical circuit connected to said first terminal, and a switch having a control terminal, a first end, and a second end, said control terminal being supplied with an output of said logical circuit, the first end being connected to said second terminal, and the second end being connected to a voltage source, and when the control signal is supplied to said first terminal, said logical circuit outputs a constant logical value for turning off said switch irrespective of a change in value of the control signal.

5. The board according to claim 4, wherein when the inspection signal is supplied to said first terminal, said logical circuit changes a logical value to be output according to a change in value of the control signal.

6. A printhead mountable on a printing apparatus, the printhead comprising:

a board; and a tank configured to store a liquid to be discharged by a printing element of said board, wherein said board comprises:

a first terminal, second terminal, and a third terminal, which are used for connection to the printing apparatus;

said printing element configured to discharge the liquid;

a driving circuit connected to said first terminal;

an inspection circuit having an input node connected to said first terminal and an output node connected to said second terminal; and a resistance element having a first node connected to said third terminal and a second node connected to an electrical path between the output node of said inspection circuit and said second terminal, wherein when an inspection signal for inspecting a connection state between the printing apparatus and the printhead is supplied from the printing apparatus to said first terminal, said inspection circuit outputs and output signal according to the inspection signal from said second terminal, and when a control signal for performing printing is supplied from the printing apparatus to said first terminal, said driving circuit drives said printing element according to the control signal, and said inspection circuit sets said inspection circuit and said second terminal in an open state with each other.

7. A printhead mountable on a printing apparatus, the printhead comprising:

a board; and a holding structure configured to exchangeably hold a tank for storing a liquid to be discharged by aprinting element of said board, wherein said board comprises:

a first terminal, a second terminal, and a third terminal, which are used for connection to the printing apparatus;

a printing element configured to discharge the liquid;

a driving circuit connected to said first terminal;

an inspection circuit having an input node connected to said first terminal and an output node connected to said second terminal; and a resistance element having a first node connected to said third terminal and a second node connected to an electrical path between the output node of said inspection circuit and said second terminal, wherein when an inspection signal for inspecting a connection state between the printing apparatus and the printhead is supplied from the printing apparatus to said first terminal, said inspection circuit outputs signal according to the inspection signal from said second terminal, and when a control signal for performing printing is supplied from the printing apparatus to said first terminal, said driving circuit drives said printing element according to the control signal, and said inspection circuit sets said inspection circuit and said second terminal in an open state with each other.

8. A printing apparatus on which a printhead is mountable, comprising:

a first terminal, a second terminal, and a third terminal, which are used for connection to the printhead;

a determination unit for determining a connection state between the printing apparatus and the printhead based on a voltage of said second terminal when an inspection signal is output from said first terminal;

a print control unit for outputting, from said first terminal, a control signal for driving the printhead to discharge a liquid; and a measurement unit for measuring a resistance value between said second terminal and said third terminal.

9. The apparatus according claim 8, wherein said print control unit adjusts a driving condition of the printhead according to the resistance value measured by said measurement unit.

10. The apparatus according to claim 8, wherein the printhead includes a logical circuit, when the printing apparatus is connected to the printhead, said first terminal is connected to the logical circuit, and the control signal is a signal for causing the logical circuit to output a constant logical value irrespective of a change in value of the control signal when the control signal is input to the logical circuit.

11. The apparatus according to claim 10, wherein the inspection signal is a signal for changing, according to a change in value of the inspection signal, a logical value to be output from the logical circuit when the inspection signal is input to the logical circuit.

12. The board according to claim 1, wherein said inspection circuit sets said inspection circuit and said second terminal in the open state with each other so that the printing apparatus can measure a resistance value of said resistance element by measuring a resistance value between said second terminal and said third terminal.

13. The apparatus according to claim 8, wherein said measurement unit is configured to measure the resistance value between said second terminal and said third terminal while said print control unit outputs the control signal from said first terminal.

* * * * *